US005429350A

United States Patent [19]

Meier

[11] Patent Number: 5,429,350

[45] Date of Patent: Jul. 4, 1995

[54] GOAL POST INSERTS

[76] Inventor: Greg Meier, 2503-09 S. Pulaski Rd., Chicago, Ill. 60623

[21] Appl. No.: 223,452

[22] Filed: Apr. 5, 1994

[51] Int. Cl.[6] ..... A63B 67/00

[52] U.S. Cl. ..... 273/55 D

[58] Field of Search ..... 273/55 D

[56] References Cited

U.S. PATENT DOCUMENTS

| | | | |
|---|---|---|---|
| 1,797,691 | 1/1929 | Merrill . | |
| 2,074,125 | 4/1936 | Lefft et al. . | |
| 2,884,252 | 10/1957 | Thompson . | |
| 3,502,330 | 1/1967 | Cheftel . | |
| 3,516,666 | 6/1977 | Mrimble | 273/55 D |
| 3,586,326 | 6/1971 | McKenna | 273/55 D |
| 3,782,724 | 1/1974 | Rottman | 273/55 D |
| 3,825,261 | 7/1974 | Zapos | 273/55 D |
| 4,353,661 | 10/1982 | Rüther . | |
| 4,368,891 | 1/1983 | Neisius . | |
| 4,535,988 | 8/1985 | Foley | 273/55 D |
| 4,958,953 | 9/1990 | Charondiere . | |
| 5,083,882 | 1/1992 | Liu . | |
| 5,219,449 | 6/1993 | Hoshino . | |

*Primary Examiner*—Theatrice Brown

[57] ABSTRACT

An improvement in the design of football goalposts wherein three cylindrical inserts are used in critical junction areas of stress in a goalpost wherein the first two cylindrical inserts are positioned in each upright and have a saddle adapted to fit and circumscribe a portion of the outer annular surface of the crossbar and which is attached to the upright by providing at least one threaded fastening means extending through an aperture in the sidewall and through a tapped bore within the cylindrical insert, and wherein the third cylindrical insert is likewise adapted to fit the interior of the upper end of a goalpost gooseneck and has a saddle which is adapted to fit and circumscribe a portion of the outer annular surface of the crossbar.

9 Claims, 3 Drawing Sheets

GOAL POST INSERTS

BACKGROUND OF THE INVENTION

This invention relates to improvements in goalposts for field games, and particularly to goalposts used in football games. Football goalposts normally consist of a gooseneck extending from the ground and attaching to a crossbar, with two vertical uprights being attached to either end of the crossbar. The goalpost is typically made with standard aluminum pipe. It is customary for overzealous fans to attempt to pull goalposts down after football games, damaging the goalpost and potentially causing injury to others. This invention provides a new structural design for a goalpost which prevents fans from destroying them.

DESCRIPTION OF THE PRIOR ART

None of the discovered prior art discloses an invention embodying all of the features of the present invention. U.S. Pat. No. 2,074,125, issued to Lefft discloses a device that may be removed immediately following field games, eliminating the possibility of fans to destroy the device. This device contains a socket for mounting the device contained in a box located below the surface of the field, slidable uprights which retract into the box, and a locking means to hold the upright in place. This patent does not disclose a structural design which provides increased strength in critical junction areas that prevents the goalpost from being destroyed when fans attempt to tear it down.

U.S. Pat. No. 2,884,252, issued to Thompson, discloses a device for retracting goalposts into the ground, once again removing the goalpost from the field and preventing the opportunity for damage to the goalpost or injury to the fans or others. This device consists of two vertical uprights with a crossbar midway between them, a rack and pinion system located below the level of the field, and a means for retracting the goalpost so the top of the uprights are flush with the field. This is a highly complex and expensive mechanism, and it is not adapted to the current industry standard goalpost design of one gooseneck support being positioned between the ground and the crossbar.

Other prior art discloses methods for joining tubular members together. However, none of this prior art discloses a joining means similar to the present invention, and none of it is particularly adaptable to a football goalpost.

SUMMARY OF THE INVENTION

The present invention provides a design for goalposts used in football games that will withstand the stress of fans mounting it and attempting to tear it down. This invention provides a method of constructing football goalposts so that the critical structural areas are strengthened. The present invention has proven to be such a vast improvement over conventional goalpost designs that it has supported the weight of at least twenty two fans at one time. This invention prevents the expense of replacing goalposts destroyed by fans, and prevents potential injuries when fans fall from it or are hit by a falling goalpost. Thus, it can also decrease tremendous liability associated with conventional goalposts.

The invention consists of a typical goalpost design having two uprights with circular sidewalls, a crossbar having two outer marginal ends, and a gooseneck with circular sidewalls extending from the ground through a ninety degree arc with its proximal end being connected to the midpoint of the crossbar. Improvements to the basic design consist of installing three solid cylindrical inserts for added structural strength in the critical junctures, namely where the upright and crossbar join and also where the gooseneck and crossbar join. One insert is adapted to fit the interior of each upright bar and has a saddle at its bottom end which is adapted to fit and circumscribe a portion of the annular surface of the crossbar. The cylindrical inserts are preferably manufactured from machined solid metal bar stock, but can be laterally bored through so as to decrease the weight of the part and yet provide the necessary strength.

When goalposts are assembled in their proper position at either end of a football field, the gooseneck extends from the ground up through a ninety degree arc towards the field and is attached to the mid portion of a crossbar. Two uprights are attached to either end of the outer marginal portions of the crossbar. The uprights contain two apertures in the distal annular portion. The cylindrical inserts that are placed in the vertical uprights each have two tapped bores, extending inwardly. The cylindrical inserts are attached to the vertical uprights by using a fastening means consisting of two hex headed bolts extending through the apertures located in the distal annular portion of the uprights, and into the tapped bores of the cylindrical insert. By placing the bolts in the distal annular portion of the upright, the bolt heads cannot be seen from the field. This adds to a more favorable visual appearance of the goalpost.

The cylindrical inserts that are placed in the vertical upright bars may include a shoulder that mates with the end of the vertical upright tube. This shoulder is designed to insure correct placement of the uprights on the vertical insert for ease of installation. By using a shoulder, the apertures located in the distal annular portion of the upright bars may be easily aligned with the tapped bores in the cylindrical inserts and the bolts can then readily be driven into the inserts.

The two inserts that are placed in the vertical uprights also have a saddle that is adapted to circumscribe a portion of the outer annular surface of the crossbar. The cylindrical inserts are attached to the crossbar by welding them to the outer marginal portion of the crossbar.

A third cylindrical insert lies horizontally and is adapted to fit inside the gooseneck. This insert has a saddle portion on its proximal end that is adapted to circumscribe a portion of the outer annular surface of the midpoint of the crossbar. This insert is likewise welded to the crossbar around the saddle tips and the saddle arch. The gooseneck contains four small apertures in its outer annular surface which are adapted to receive a bolt passed therethrough. These apertures are located in the central horizontal plane of the upper end of the gooseneck. The third cylindrical insert has four corresponding tapped bores also lying in the central horizontal plane which extend inwardly. The cylindrical insert is attached to the gooseneck by providing four hex headed bolts which pass through the apertures in the outer annular surface of the gooseneck which are driven into the tapped bores of the insert. These bolts all lie in the same central horizontal plane that is parallel to the ground, and the apertures and tapped bores are positioned so that the apertures and bores of one side are offset approximately one inch from the apertures and bores of the other side. This provides optimal structural integrity to the design of the gooseneck receiving structure.

Thus, it is a major objective of the present invention to provide an improved goalpost device that will function as a traditional football goalpost, but withstand the abuse of fans who attempt to tear down the vertical uprights after sporting events by adding markedly increased structural strength in the critical support areas of the junction of the gooseneck and crossbar and the two junctions where the uprights connect to the crossbar so as to avoid the costly replacement of the goalposts after an exciting game.

It is another objective of the present invention to provide an improved goalpost design that will withstand the attempts of fans to tear down the vertical uprights through increased structural support in the critical junction areas of the gooseneck and crossbar and the uprights and crossbar so as to avoid injury to the fans caused by a falling uprights and/or crossbars.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
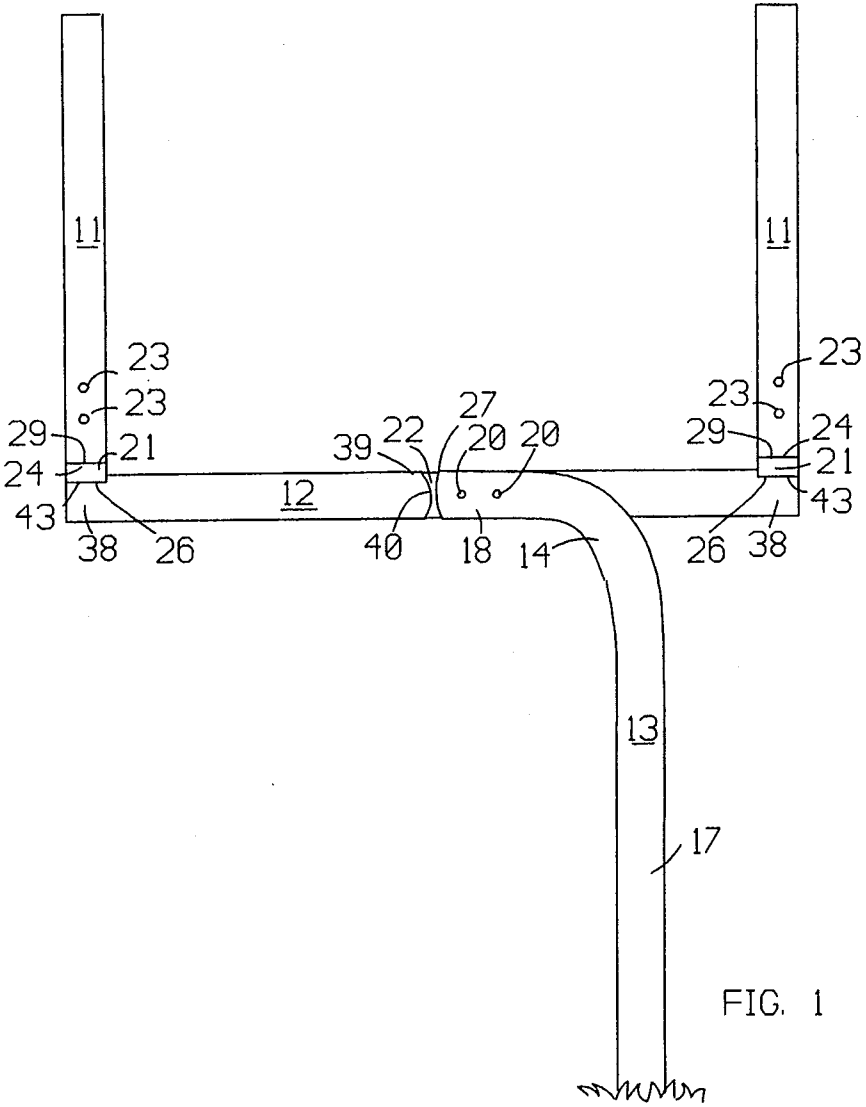
FIG. 1 is a perspective view of the goalpost incorporating the two vertical inserts in the uprights and the horizontal insert in the gooseneck.

Referring to FIG. 1, a perspective view of the invention comprising goalpost 10 is shown. The bottom portion of the gooseneck 17 is inserted in the ground and extends from the ground upward through a ninety degree arc 14 to the midpoint of the crossbar 12. The gooseneck 13 is preferably made of Schedule 80 steel pipe or its equivalent in strength with at least a 6 ⅝" outside diameter and a 0.432" wall. Also, it is preferred that it is made of one piece bent over mandrel construction. The upper portion of the gooseneck 18 is attached to the horizontal insert 22. The horizontal insert 22 is attached to the gooseneck 13 by means of four hex headed bolts 20, two of which are shown here in FIG. 1. The horizontal insert 22 is attached to the crossbar 12 with weld bead 27 running along the top of crossbar 12 and weld fillet 39 which runs along saddle arch edge 40. The crossbar is preferably made of Schedule 40 steel pipe or its equivalent in strength with at least a 6" outside diameter and 0.280" wall thickness.

Two uprights 11 are attached to vertical inserts 21 with hex head bolts 23. The hex headed bolts 23 are preferably made of alloy steel SAE Grade 8 or its equivalent. The uprights 11 are preferably made of aluminum with at least a 4" outer diameter with a 0.25" wall thickness. The vertical inserts 21 are attached the outer marginal portions 38 of the crossbar 12 with weld bead 26. The vertical inserts 21 include an annular shoulder 24. This annular shoulder 24 abuts and bears upon upright bottom end 29. The gooseneck 14, crossbar 12, and uprights 11 will preferably all be provided with an initial coat of primer paint as well as a finish coat to prevent corrosion.

Figure 2:
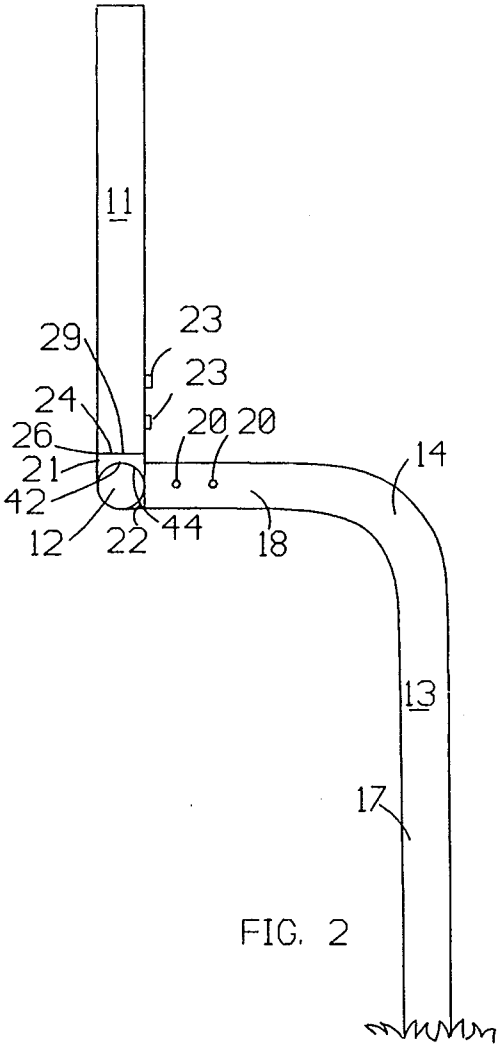
FIG. 2 is a side view of the goalpost incorporating a vertical insert in the upright and the horizontal insert in the gooseneck.

Referring to FIG. 2, a side view of goalpost 10 is shown. The upper horizontal portion 18 of the gooseneck 13 is attached to horizontal insert 22 with hex head bolts 20. The upright 11 is attached to vertical insert 21 with hex head bolts 23. The vertical insert 21 is attached to the crossbar 12 with weld bead 26 as well as weld fillet 44 which runs along saddle arch edge 42. The annular shoulder 24 of the vertical insert 21 abuts and bears upon upright bottom end 29.

Figure 3:
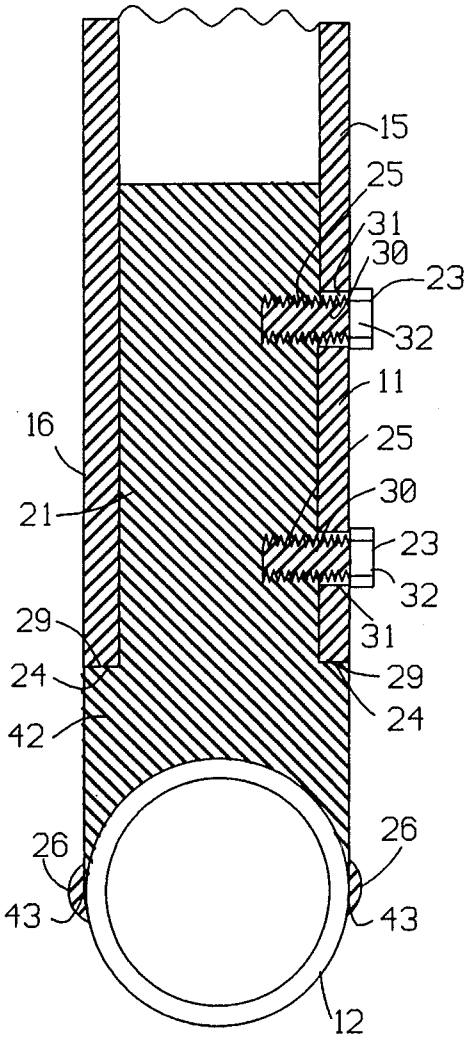
FIG. 3 is a cross-sectional broken away view of one vertical insert mounted inside an upright which is attached to the crossbar.

FIG. 3 shows a cross section of one upright 11 which is attached to a vertical insert 21 with hex head bolts 23. The preferred bolt head is hex head 32, but any bolt of suitable strength and head configuration, such as a pan head bolt, may be substituted. The bolts are preferably made of alloy steel of SAE Grade 8 or equivalent strength. The distal portion 15 of the upright 11 contains vertical sidewall apertures 31 which positions hex head bolts 23 so that they cannot be seen from the field. This improves the visual appearance of the goalpost. The hex head bolts 23 pass through the vertical sidewall apertures 31, so as to allow threaded shaft 30 to pass therethrough into the tapped bore 25 which extends inwardly into vertical insert 21.

Vertical insert 21 is attached to the crossbar 12 at weld bead 26. Annular shoulder portion 24 of the vertical insert 21 mates with the upright bottom end 29. Annular shoulder portion 24 abuts and bears upon upright 11 and the vertical insert 21, and allows the uprights 11 to be easily installed upon insert 21.

Figure 4:
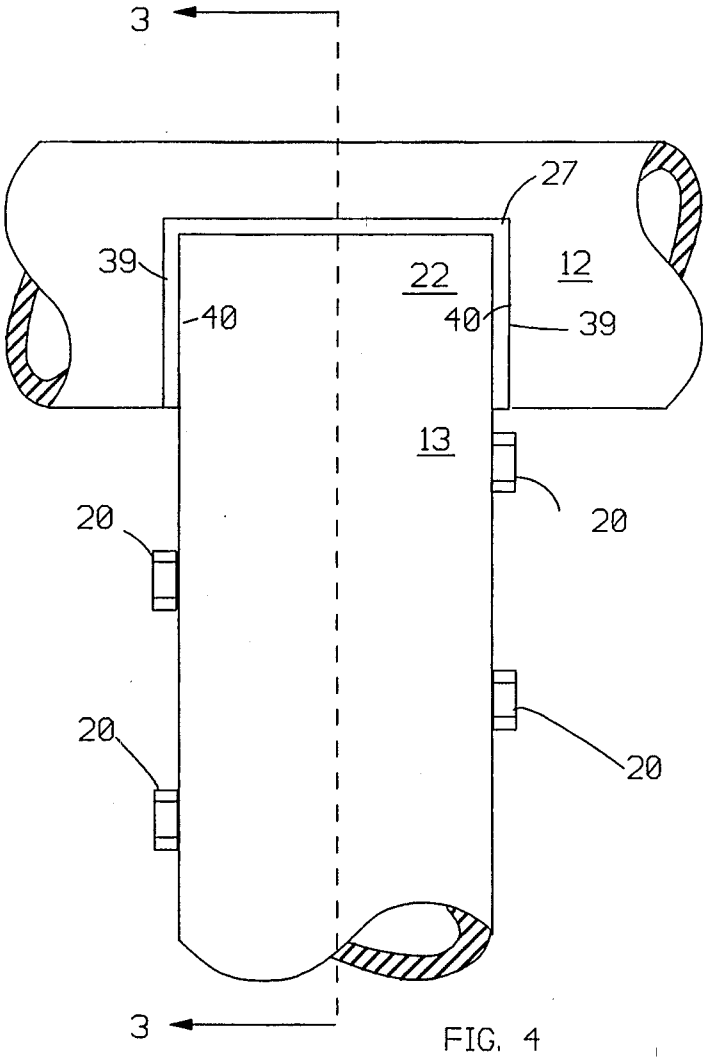
FIG. 4 is a break away top view of the goal post at the junction where the gooseneck is attached to the crossbar.

Referring to FIG. 4, a break away top view of gooseneck 13 is attached to insert 22 which in turn is fastened onto crossbar 12 as shown. The upper horizontal portion 18 of the gooseneck 13 is attached to the horizontal insert 22 with four hex head bolts 20. Vertical insert 22 is attached to the crossbar 12 by weld bead 27 which runs along saddle end tip 41, as well as weld fillet 39 which runs along saddle arch edge 40.

Figure 5:
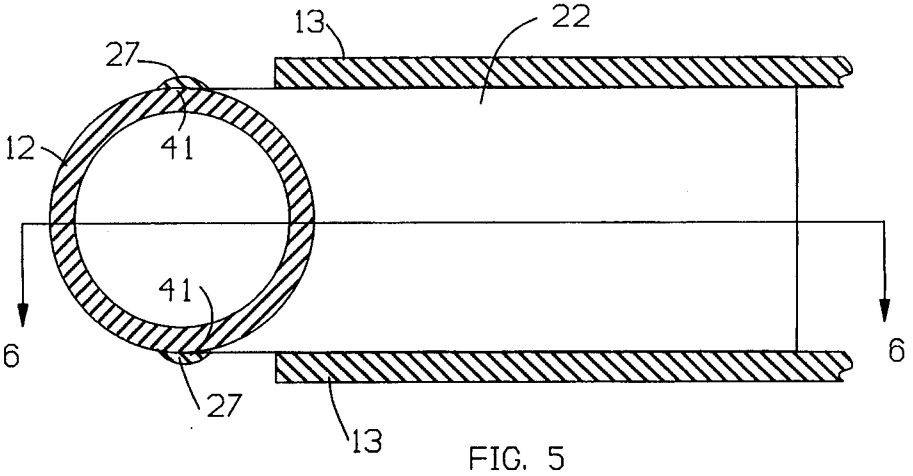
FIG. 5 is a cross-sectional view of the horizontal insert as it is attached to the midpoint of the crossbar which is taken along 3—3 from FIG. 4.

Referring to FIG. 5, a cross-sectional view of 3—3 from FIG. 4 shows a central cross sectional view of horizontal insert 22 within the gooseneck 13 which is attached to crossbar 12 by weld bead 27 which runs along saddle end tip 41 as shown in FIG. 4.

Figure 6:
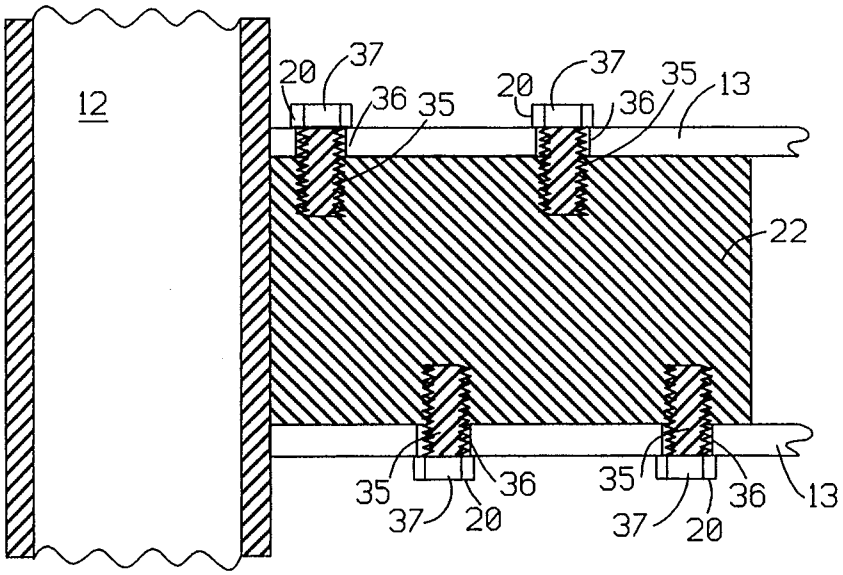
FIG. 6 is a cross-sectional view of the horizontal insert as it is attached to the midpoint of the crossbar which is taken along 6—6 of FIG. 5.

FIG. 6 shows a cross-sectional broken away view of 6—6 from FIG. 5. Cylindrical insert 22 is attached to gooseneck 13 and crossbar 12. The cylindrical insert 22 is attached to the gooseneck 13 with four hex head bolts 20. Hex bolt head 37 is shown in this Figure, but any bolt of suitable strength, such as one with a pan head, may be substituted. The crossbar 12 contains four sidewall apertures 36 allowing threaded shaft 35 to pass therethrough. Threaded shaft 35 may be driven into horizontal insert 22 securing the horizontal insert 22 to gooseneck 13. FIG. 6 also shows how the fastening means, or hex head bolts 20, are offset by approximately one inch although they all lie within the same central horizontal plane.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A football goalpost having two uprights each having open lower interiors and outer sidewalls;

a gooseneck with an outer sidewall and an open upper end, the gooseneck extending from the ground up through a ninety degree bend which terminates at the upper open end;

a horizontal crossbar with an outer surface; the improvement comprising, at least one strengthening insert adapted to fit within either the open lower interior of one of the uprights, or the open upper end of the gooseneck, and which strengthening insert further has a saddle portion which is adapted to fit and circumscribe at least a portion of the outer surface of the crossbar.

2. The device according to claim 1 in which the strengthening insert is secured within either the open lower interior of one of the uprights or the open upper end of the gooseneck by a fastening means.

3. The device according to claim 2 in which the saddle portion of the strengthening insert is secured to the outer surface of the crossbar by a fastening means.

4. The device according the claim 3 where the fastening means for attaching the saddle portion of the strengthening insert to the outer surface of the crossbar is a welded seam.

5. The device according to claim 2 where the outer sidewalls of the uprights or the upper end of the gooseneck is provided with at least one aperture and the strengthening insert is provided with at least one corresponding tapped bore and the fastening means for securing the strengthening insert to either the open lower interior of one of the uprights or the open upper end of the gooseneck consists of a bolt with a threaded shaft which passes through the aperture and is driven into the corresponding tapped bore.

6. The device according to claim 1 further having three strengthening inserts, two of which are secured within open lower interiors of each upright, and one of which is secured within the open upper end of the gooseneck.

7. The device according to claim 6 where the strengthening inserts in the open lower interiors of each upright have at least one tapped bore, and the strengthening insert in the open upper end of the gooseneck has at least two tapped bores, the two uprights each have a rear annular portion and at least one aperture located therein and at least one threaded fastener which extends through the aperture and is driven into the tapped bore of the insert;

the upper open end of the gooseneck has opposing sides and at least two apertures located in a single horizontal plane on opposing sides, and at least two threaded fasteners extending through each aperture and are driven into the tapped bores of the insert.

8. The device according to claim 1 wherein;

each upright further has a bottom edge, and the two strengthening inserts in each upright have a shoulder portion which abuts and bears upon the bottom edge of each upright.

9. The device according to claim 1 wherein the three strengthening inserts are made from solid bar stock.

* * * * *